US010309704B2

(12) United States Patent
Pereira

(10) Patent No.: US 10,309,704 B2
(45) Date of Patent: Jun. 4, 2019

(54) COMPRESSOR WITH AN OIL SEPARATOR BETWEEN COMPRESSING STAGES

(71) Applicant: The Coca-Cola Company, Atlanta, GA (US)

(72) Inventor: Roberto Horn Pereira, Suwanee, GA (US)

(73) Assignee: The Coca-Cola Company, Atlanta, GA (US)

( * ) Notice: Subject to any disclaimer, the term of this patent is extended or adjusted under 35 U.S.C. 154(b) by 57 days.

(21) Appl. No.: 15/038,234

(22) PCT Filed: Nov. 19, 2014

(86) PCT No.: PCT/US2014/066285
§ 371 (c)(1),
(2) Date: May 20, 2016

(87) PCT Pub. No.: WO2015/077275
PCT Pub. Date: May 28, 2015

(65) Prior Publication Data

US 2016/0290693 A1 Oct. 6, 2016

Related U.S. Application Data

(60) Provisional application No. 61/908,227, filed on Nov. 25, 2013.

(51) Int. Cl.
*F25B 43/02* (2006.01)
*F25B 1/10* (2006.01)
(Continued)

(52) U.S. Cl.
CPC ..... *F25B 43/02* (2013.01); *F25B 1/10* (2013.01); *F25B 9/008* (2013.01); *F25B 31/004* (2013.01);
(Continued)

(58) Field of Classification Search
CPC ..... F25B 1/10; F25B 2309/061; F25B 9/008; F25B 31/004; F25B 43/02
(Continued)

(56) References Cited

U.S. PATENT DOCUMENTS 3,168,236 A * 2/1965 Lamberton ..... F04C 28/06 417/295
3,449,017 A * 6/1969 Klein ..... B60T 1/087 188/271
(Continued)

FOREIGN PATENT DOCUMENTS

CN 202209828 U 5/2012
EP 0478939 4/1992
(Continued)

OTHER PUBLICATIONS

Machine translation of Tamai, Oct. 1996, PAJ, JP 08-261574, description.*
(Continued)

*Primary Examiner* — Filip Zec
(74) *Attorney, Agent, or Firm* — Eversheds Sutherland (US) LLP

(57) ABSTRACT

The present application provides a compressor for use with a flow of carbon dioxide. The compressor may include a first stage compression mechanism for compressing the flow of carbon dioxide from a low pressure to an intermediate pressure, an oil separator downstream of the first stage compression mechanism, and a second stage compression mechanism positioned downstream of the oil separator for compressing the flow of carbon dioxide from the intermediate pressure to a high pressure.

18 Claims, 3 Drawing Sheets

(51) Int. Cl.
*F25B 9/00* (2006.01)
*F25B 31/00* (2006.01)
*F25B 31/02* (2006.01)

(52) U.S. Cl.
CPC ..... *F25B 31/026* (2013.01); *F25B 2309/061* (2013.01)

(58) Field of Classification Search
USPC ..... 62/470, 471
See application file for complete search history.

(56) References Cited

U.S. PATENT DOCUMENTS

| | | | | |
|---|---|---|---|---|
| 5,016,447 | A | 5/1991 | Lane | |
| 5,282,370 | A * | 2/1994 | Kiblawi | F25B 43/006 138/44 |
| 5,787,573 | A * | 8/1998 | Pytel | F25B 43/006 29/890.06 |
| 6,389,842 | B1 * | 5/2002 | Telesz | F04B 39/0055 62/503 |
| 6,439,261 | B1 * | 8/2002 | Bush | G05D 16/103 137/505.18 |
| 6,871,511 | B2 | 3/2005 | Okaza | |
| 6,907,746 | B2 | 6/2005 | Sato | |
| 8,099,976 | B2 | 1/2012 | Zhang | |
| 8,186,971 | B2 | 5/2012 | Sato | |
| 8,205,469 | B2 | 6/2012 | Tsuboi | |
| 8,312,731 | B2 | 11/2012 | Tomioka | |
| 8,375,740 | B2 | 2/2013 | Yoon | |
| 8,845,243 | B2 * | 9/2014 | Hansson | B23B 27/1622 408/188 |
| 8,966,933 | B2 * | 3/2015 | Okamoto | F25B 1/10 62/196.2 |
| 9,656,198 | B2 * | 5/2017 | Sugio | B01D 45/08 |
| 2003/0121648 | A1 * | 7/2003 | Hong | F25B 40/00 165/163 |
| 2006/0230782 | A1 | 10/2006 | Imai et al. | |
| 2006/0260340 | A1 | 11/2006 | Bhatia | |
| 2009/0229300 | A1 | 9/2009 | Fujimoto | |
| 2009/0277215 | A1 | 11/2009 | Tsuboi | |
| 2010/0154465 | A1 | 6/2010 | Sakae | |
| 2010/0242529 | A1 | 9/2010 | Fujimoto et al. | |
| 2011/0000246 | A1 | 1/2011 | Fujimoto | |
| 2012/0151887 | A1 | 6/2012 | Dorao | |
| 2012/0151948 | A1 | 6/2012 | Ogata | |
| 2012/0291464 | A1 | 11/2012 | Yoon | |

FOREIGN PATENT DOCUMENTS

| | | | | |
|---|---|---|---|---|
| EP | 2551612 | | 1/2013 | |
| JP | 2008-261574 | A | 10/1996 | |
| JP | 08261574 | A * | 10/1996 | F25B 1/10 |
| JP | 2000-110765 | A | 4/2000 | |
| JP | 2008-175066 | A | 7/2008 | |
| WO | 2012101864 | | 8/2012 | |
| WO | 2013027237 | | 2/2013 | |

OTHER PUBLICATIONS

Machine translation of Mitsubishi, Jul. 2008, eSpace, JP 2008-175066, description.*

PCT Notification of Transmittal of The International Search Report, International Application No. PCT/US2014/066285, International Filing Date Nov. 19, 2014; Applicant: The Coca-Cola Company.

PCT Written Opinion of the International Searching Authority, International Application No. PCT/US2014/066285, International Filing Date Nov. 19, 2014; Applicant: The Coca-Cola Company.

* cited by examiner

COMPRESSOR WITH AN OIL SEPARATOR BETWEEN COMPRESSING STAGES

TECHNICAL FIELD

The present application and the resultant patent relate generally to refrigeration systems and more particularly relate to refrigeration systems using carbon dioxide as the refrigerant and having a two-stage compressor with an oil separator therein.

BACKGROUND OF THE INVENTION

Modern refrigeration systems provide cooling, ventilation, and humidity control for all or part of an enclosure. Such enclosures may include a refrigerator, a cooler, a vendor, a dispenser, and other types of light commercial or household appliances.

Because of environmental, financial, and other reasons, these modern refrigeration systems are increasing moving away from the use of synthetic refrigerants such as hydrofluorocarbons. Given such, there is an increased interest in the use of natural refrigerants such as carbon dioxide and the like. The use of carbon dioxide as the refrigerant may have the advantages of being relatively inexpensive, readily available, non-toxic, nonflammable, and environmentally friendly. Moreover, carbon dioxide generally has a higher volumetric capacity as compared to most common synthetic refrigerants.

Generally described, a carbon dioxide refrigeration cycle may be similar to other types of refrigeration cycles but may operate at higher pressures and may not involve a change in state. The typical supercritical carbon dioxide refrigeration cycle may include compressing the flow of carbon dioxide within a compressor at a high pressure and a high temperature. Second, the compressed carbon dioxide may be cooled within a gas cooler or other type of heat exchanger by heat exchange with the surrounding environment. Third, the carbon dioxide may pass through an expansion device that reduces both the pressure and the temperature. Fourth, the carbon dioxide may be pumped to an evaporator or a further heat exchanger where the carbon dioxide may absorb heat from an enclosure so as to provide cooling therein. The flow of carbon dioxide then may be returned to the compressor so as to repeat the cycle. Many variations on such a carbon dioxide refrigeration cycle may be known.

One way to improve the efficiency of a carbon dioxide refrigeration system is to use a two-stage compressor. The miscibility of oil in carbon dioxide in such carbon dioxide refrigeration systems, however, may be greater as compared to typical synthetic refrigerants at high operating pressures. Moreover, the miscibility of oil in carbon dioxide may increase as the pressure increases. Such an increase in the oil content of the refrigerant may present a challenge at the evaporator and elsewhere. Specifically, oil may begin to accumulate in the evaporator as the temperature of the refrigerant is reduced.

Moreover, the viscosity of the oil may increase so as to lead potentially to increased maintenance needs, premature failure of the components, clogging, and other types of ongoing maintenance issues.

Although different types of oil separators are known, such systems generally require pumps and/or complex valve arrangements due to the pressure differential between the inlet and outlet of the compressor. Moreover, such known oil separators may be ineffective with respect to two-stage compressors given that the oil is needed within a shell casing at an intermediate pressure.

There is thus a desire for an improved carbon dioxide refrigeration system for use with light commercial or household appliances and the like. Such an improved carbon dioxide refrigeration system may accommodate the increased miscibility of oil in the carbon dioxide refrigerant at higher pressures for an increase in overall system performance and efficiency with a reduction in maintenance requirements.

SUMMARY OF THE INVENTION

The present application and the resultant patent thus provide a compressor for use with a flow of carbon dioxide. The compressor may include a first stage compression mechanism for compressing the flow of carbon dioxide from a low pressure to an intermediate pressure, an oil separator downstream of the first stage compression mechanism, and a second stage compression mechanism positioned downstream of the oil separator for compressing the flow of carbon dioxide from the intermediate pressure to a high pressure.

The present application and the resultant patent further provide a method of compressing a flow of carbon dioxide for use in a refrigeration system. The method may include the steps of compressing the flow of carbon dioxide from a low pressure to an intermediate pressure in a first stage compressor, passing the flow of carbon dioxide at the intermediate pressure through an oil separator, and then compressing the flow of carbon dioxide from the intermediate pressure to a high pressure in a second stage compressor.

The present application and the resultant patent thus provide a compressor for use with a flow of a refrigerant. The compressor may include a shell casing, a first stage compression mechanism for compressing the flow of the refrigerant from a low pressure to an intermediate pressure positioned within the shell casing, an oil separator downstream of the first stage compression mechanism and positioned outside the shell casing, a second stage compression mechanism downstream of the oil separator for compressing the flow of refrigerant from the intermediate pressure to a high pressure positioned within the shell casing, and a motor to drive the first stage compression mechanism and the second stage compression mechanism positioned within the shell casing. The oil separator may include an expansion chamber and/or a J-tube positioned within the expansion chamber and/or an oil drain in communication with a shell casing. The refrigerant may include a flow of carbon dioxide.

DETAILED DESCRIPTION

Figure 1:
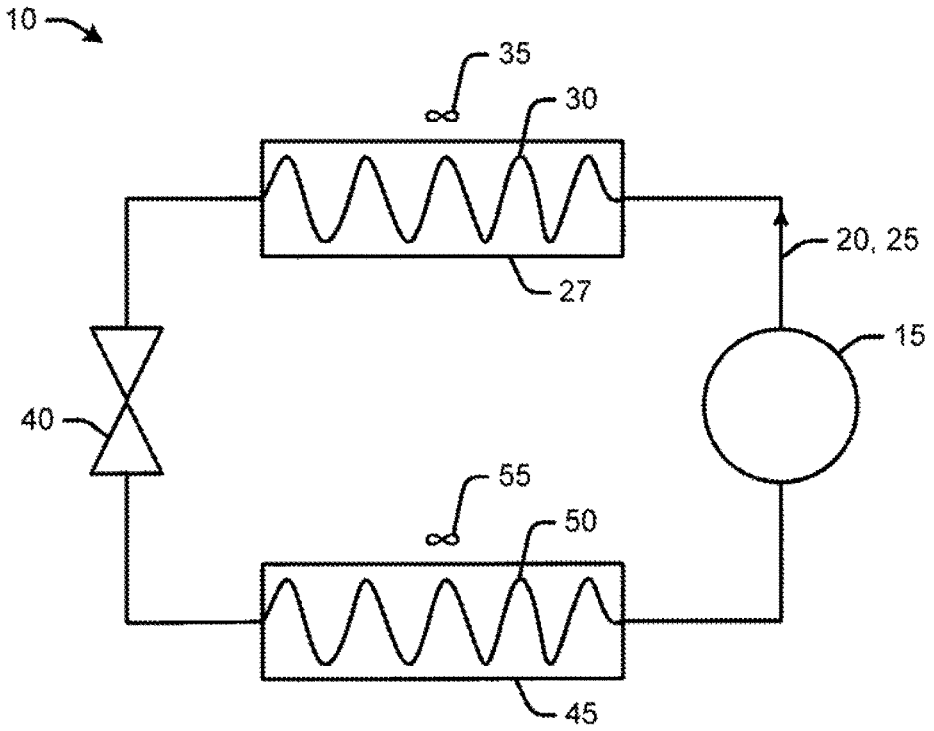
FIG. 1 is schematic diagram of a known carbon dioxide refrigeration system.

Referring now to the drawings, in which like numerals refer to like elements throughout the several views, FIG. 1 shows an example of a refrigeration system 10 as may be described herein. The refrigeration system 10 may be used to cool any type of enclosure such as a refrigerator, a cooler, a vendor, a dispenser, and the like. The overall refrigeration system 10 may have any suitable size or capacity. The refrigeration system 10 also may be applicable to air conditioning and/or heating systems. Although primarily directed towards light commercial or household appliances, the refrigeration system 10 also may have other types of commercial, industrial, and/or residential applications.

The refrigeration system 10 may include a compressor 15. The compressor 15 may have any suitable size or capacity. The compressor 15 may compress a flow of refrigerant 20 at a high pressure and a high temperature. In this example, the refrigerant 20 may be a flow of carbon dioxide 25. The flow of carbon dioxide 25 may be in a supercritical cycle or in a sub-critical cycle depending upon the ambient temperatures in which the compressor 15 operates and other types of operational parameters.

The refrigeration system 10 may include a gas cooler 27 or other type of heat exchanger positioned downstream of the compressor 15. The gas cooler 27 may have any suitable size or capacity. The gas cooler 27 may include a number of coils 30 therein or other type of heat exchange surface. A gas cooler fan 35 may be positioned adjacent thereto. The gas cooler fan 35 may be a single speed fan, a variable feed fan, and the like. The gas cooler 27 may cool the flow of carbon dioxide 25 through heat exchange with the surrounding environment.

The refrigeration system 10 may include an expansion device 40 downstream of the gas cooler 27. The expansion device 40 may have any suitable size or capacity. The expansion device 40 may reduce the pressure and temperature of the flow of carbon dioxide 25. The expansion device 40 may include a number of capillary tubes and the like therein.

The refrigeration system 10 also may include an evaporator 45 or other type of heat exchanger positioned downstream of the expansion device 40. The evaporator 45 may have any suitable size or capacity. The evaporator 45 may include a number of evaporator coils 50 or other type of heat exchange surface. An evaporator fan 55 may be positioned adjacent thereto. The evaporator fan 55 may be a single speed fan, a variable speed fan, and the like. The flow of carbon dioxide 25 may be pumped to the evaporator 45. The flow of carbon dioxide 25 may absorb heat with a flow of air blown or drawn across the evaporator coils 50 by the evaporator fan 55 so as to cool an enclosure and the like. The flow of carbon dioxide 25 then may be returned to the compressor 15 so as to repeat the cycle. Other components and other configurations may be used herein. The refrigeration system 10 described herein is for the purpose of example only. Many other types of refrigeration systems, refrigeration components, and refrigerants may be known.

Figure 2:
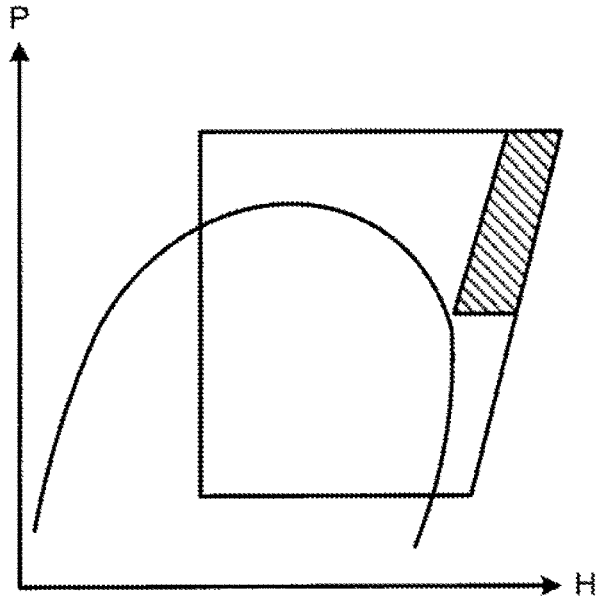
FIG. 2 is a pressure/enthalpy chart showing the work savings in a two-stage compressor.

As described above, one way to improve the efficiency of the refrigeration system 10 is to use a two-stage compressor 60. As is shown in the pressure-enthalpy chart of FIG. 2, the refrigerant 20 may be input to the compressor 60 at a low pressure $P_L$, may be compressed to an intermediate pressure $P_M$ in a first stage of the compressor, cooled while maintaining the intermediate pressure $P_M$, and then be compressed to a high pressure $P_H$ in a second stage of the compressor. As a result, a savings in the amount of total work required to be performed by the compressor 60 may be realized as is shown in the crosshatched area of the graph.

Figure 3:
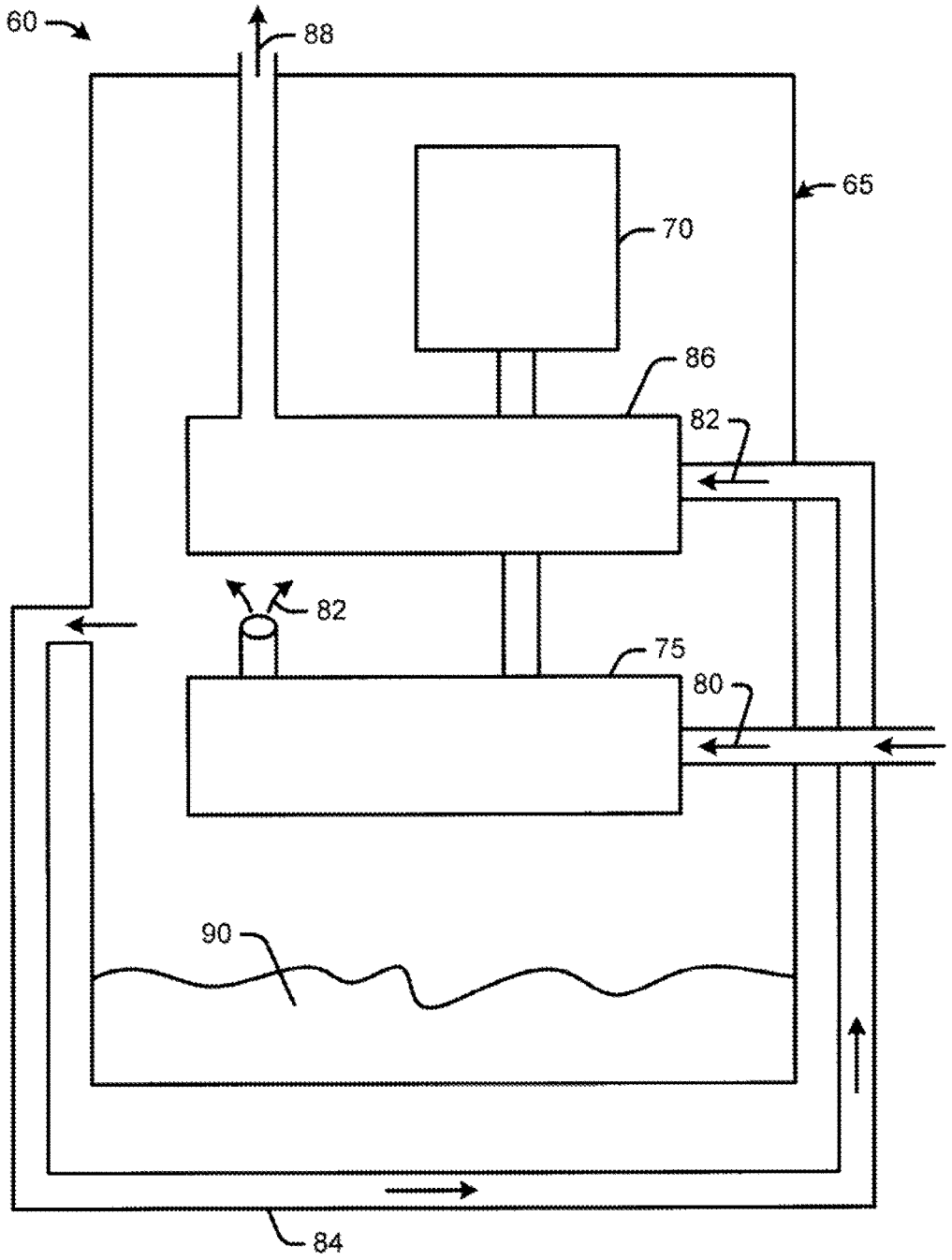
FIG. 3 is a schematic diagram of a known two-stage compressor for use in the refrigeration system of FIG. 1.

FIG. 3 shows an example of the two-stage compressor 60. The components of the two-stage compressor 60 may be enclosed within a shell casing 65. The shell casing 65 may be suitable for enclosing at least an intermediate pressure fluid. The shell casing 65 may have any suitable size, shape, or configuration. A conventional DC motor 70 may be positioned within the shell casing 65. Other types of motors and other types of drive means may be used herein.

The two-stage compressor 60 may include a first stage compression mechanism 75. The first stage compression mechanism 75 may be driven by the motor 70. The first stage compression mechanism 75 may compress a fluid via rotary displacement or other types of compression techniques. The first stage compression mechanism 75 may compress an incoming low pressure flow 80 to an intermediate pressure flow 82. The first stage compression mechanism 75 may discharge the intermediate pressure flow 82 within the shell casing 65. A second stage pathway 84 may extend between the shell casing 65 and a second stage compression mechanism 86. The second stage compression mechanism 86 may be driven by the motor 70 or otherwise.

The second stage compression mechanism 86 may compress a fluid via rotary displacement or other types of compression techniques. The second stage compression mechanism 86 may compress the intermediate pressure flow 82 into a high pressure flow 88. The high pressure flow 88 may be discharged towards the gas cooler 25 or elsewhere. Other components and other configurations also may be used. Other types of two stage compressors may be known.

Also as described above, although the two-stage compressor 60 improves the efficiency of the overall refrigeration system 10, the miscibility of oil 90 in the flow of the carbon dioxide refrigerant 25 may increase as the pressure increases. Specifically, the percentage of oil 90 within the flow of refrigerant 25 may increase several times between the low pressure side and the high pressure side of the compressor 15 and the overall refrigeration system 10. The presence of the oil 90 in the refrigerant 20 thus may present maintenance issues and the like.

Figure 4:
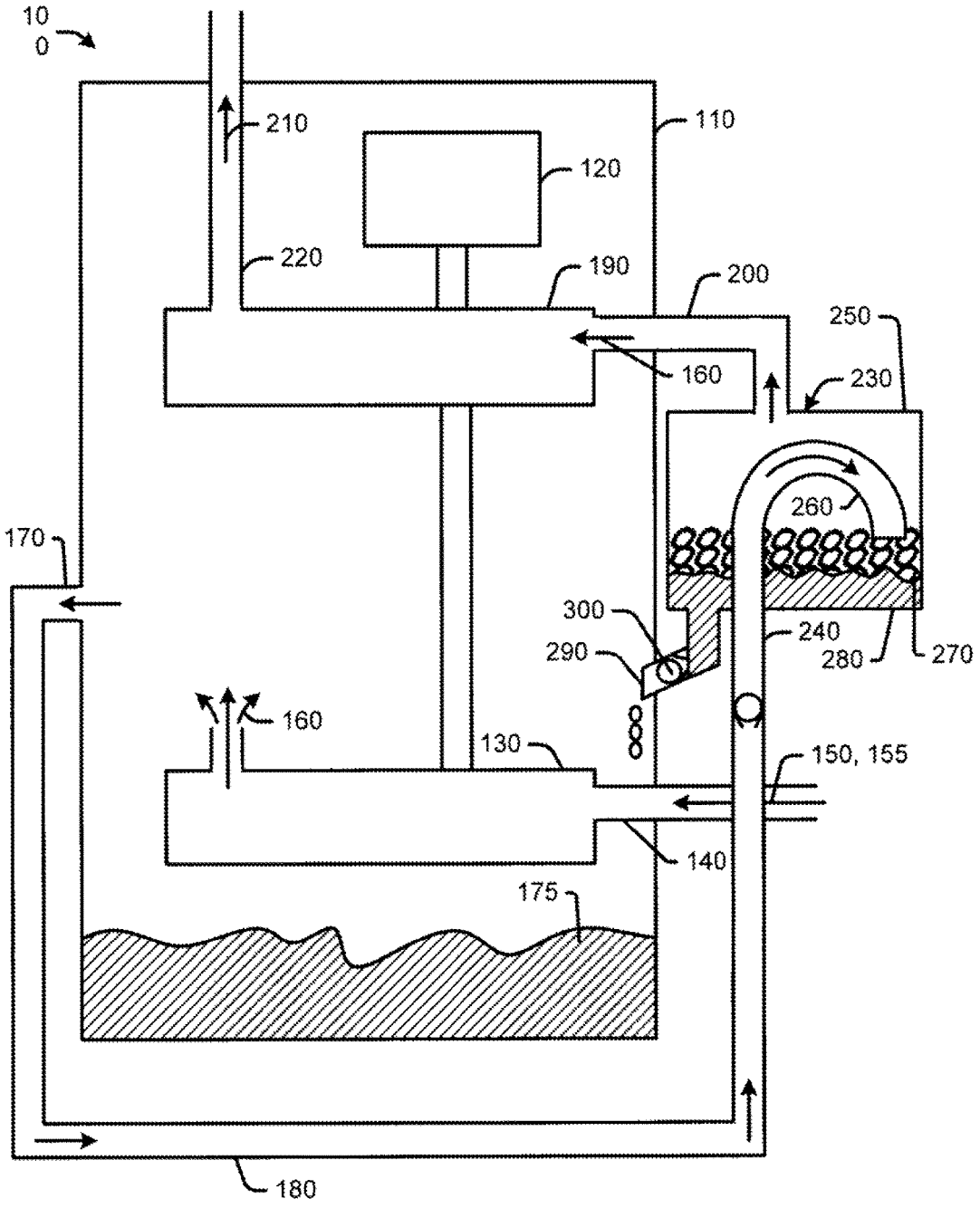
FIG. 4 is a schematic diagram of a two-stage compressor with an oil separator as may be described herein.

FIG. 4 shows an example of a two-stage compressor 100 as may be described herein. Similar to that described above, the two-stage compressor 100 may include a shell casing 110. The shell casing 110 may be suitable for enclosing at least an intermediate pressure fluid. The shell casing 110 may have any suitable size, shape, or configuration. A DC motor 120 or other type of drive device may be positioned within the shell casing 110 or elsewhere. Other components and other configurations may be used herein.

The two-stage compressor 100 may include a first stage compression mechanism 130. The first stage compression mechanism 130 may be driven by the motor 120 or otherwise. The first stage compression mechanism 130 may compress a fluid via rotary displacement or other types of compression techniques. The first stage compression mechanism 130 may have any suitable size or capacity. The first stage compression mechanism 130 may have a first stage input 140. The first stage input 140 may be in communication with a low pressure flow 150 of a carbon dioxide refrigerant 155. Other types of refrigerants also may be used herein. The first stage compression mechanism 130 may compress the low pressure flow 150 into an intermediate pressure flow 160. The first stage compression mechanism 130 may have a first stage output 170. The first stage output 170 may discharge the intermediate pressure flow 160 into the shell casing 110. Due to the discharge of the carbon dioxide refrigerant 155 within the shell casing 110, an amount of oil 175 thus may reside in the bottom thereof. Other components and other configurations may be used herein.

The shell casing 110 may include a second stage pathway 180. The second stage pathway 180 may extend from the shell casing 110 to a second stage compression mechanism 190. The second stage compression mechanism 190 may be driven by the motor 120 or otherwise. The same or different motors may drive the respective stages.

The second stage compression mechanism 190 may compress a fluid via rotary displacement or other types of compression techniques. The second stage compression mechanism 190 may have any suitable size or capacity. The second stage compression mechanism 190 may include a second stage input 200 in communication with the second stage pathway 180. The second stage compression mechanism 190 may compress the intermediate flow 160 of the carbon dioxide refrigerant 155 into a high pressure flow 210. The second stage compression mechanism 190 may include a second stage output 220. The second stage output 220 may extend out of the shell casing 110 to discharge the high pressure flow 210 towards the gas cooler 25 or elsewhere. Other components and other configurations may be used herein.

The two-stage compressor 100 also may include an oil separator 230. The oil separator 230 may be positioned about the second stage pathway 180 between the first stage mechanism 130 and the second stage mechanism 190 and outside of the shell casing 110. An input check valve 240 may be positioned about the second stage pathway 180 upstream of the oil separator 230. The oil separator 230 may include an expansion chamber 250. The expansion chamber 250 may have any suitable size, shape, or configuration. The oil separator 230 also may include a J-tube 260. The J-tube 260 may extend from the second stage pathway 180 into the expansion chamber 250. A wire mesh 270 also may be positioned about an oil pan 280 in the expansion chamber 250. The oil separator 250 may include an oil drain 290 positioned about the oil pan 280. The oil drain 290 may extend from the oil pan 280 back towards the shell casing 110. An output check valve 300 may be positioned on the oil drain 290. Other components and other configurations may be used herein.

In use, the input check valve 240 may prevent back pressure towards the shell casing 110 due to any pressure fluctuations within the oil separator 230. The oil separator 230 includes the expansion chamber 250 and the J-tube 260 so as to reduce the velocity of the flow of refrigerant 155. This reduction in the velocity may promote the separation of the oil 175 from the refrigerant 155. The wire mesh 270 may facilitate the collection of the oil 175 therein. The oil content within the refrigerant 155 exiting the oil separator 230 thus may be reduced before entry into the second stage compression mechanism 190. The oil drain 290 permits return of the separated oil 175 back into the shell casing 110.

Because the pressure in the oil separator 230 and the shell casing 110 may be similar, the oil 175 should easily drain back into the shell casing 110. The output check valve 300 may be biased such that a threshold amount of the oil 175 may accumulate within the oil separator 230 before allowing the oil 175 to drain back into the shell casing 110. The output check valve 300 also may prevent a secondary flow path from the shell casing 110 into the oil separator 230. The output check valve 300 thus may prevent the refrigerant 155 from bypassing the oil separator 230 so as to ensure that the oil content within the refrigerant 155 entering the second stage compression mechanism 190 may be sufficiently low.

The oil separator 230 thus removes excess oil 175 from the flow of refrigerant 155 before entry into the second stage compression mechanism 190 for an increase in overall efficiency and a reduction in maintenance requirements. Moreover, the oil separator 230 avoids the use of complex pumps and/or valve arrangements and/or any type of parasitic drain on the refrigeration system as a whole. Specifically, the use of the two stage compressor 100 allows for two levels of pressure within the shell casing 110. The oil separator 230 also may be used with other types of refrigerants.

I claim:

1. A compressor for use with a flow of carbon dioxide, comprising:

a first stage compression mechanism for compressing the flow of carbon dioxide from a low pressure to an intermediate pressure;

an oil separator downstream of the first stage compression mechanism; and a second stage compression mechanism downstream of the oil separator for compressing the flow of carbon dioxide from the intermediate pressure to a high pressure;

wherein the oil separator comprises an expansion chamber; and wherein the oil separator comprises a J-tube, the J-tube comprising an inlet at a bottom of the expansion chamber, an outlet within the expansion chamber and wherein the J-tube provides an approximate 180 degree turn to the flow of carbon dioxide.

2. The compressor of claim 1, wherein the first stage compression mechanism comprises a first stage input in communication with the flow of carbon dioxide at low pressure.

3. The compressor of claim 1, further comprising a shell casing and wherein the first stage compression mechanism and the second stage compression mechanism are positioned within the shell casing.

4. The compressor of claim 3, further comprising a motor positioned within the shell casing and in communication with the first stage compression mechanism and the second stage compression mechanism.

5. The compressor of claim 3, wherein the first stage compression mechanism comprises a first stage output in communication within the shell casing for the flow of carbon dioxide at intermediate pressure.

6. The compressor of claim 3, wherein the shell casing comprises a second stage pathway in communication with the second stage compression mechanism.

7. The compressor of claim 1, wherein the second stage compression mechanism comprises a second stage input in communication with the flow of carbon dioxide at intermediate pressure.

8. The compressor of claim 1, wherein the second stage compression mechanism comprises a second stage output in communication with the flow of carbon dioxide at high pressure.

9. The compressor of claim 1, wherein the oil separator comprises an oil pan and a wire mesh within the expansion chamber.

10. The compressor of claim 1, further comprising a check valve upstream of the oil separator.

11. The compressor of claim 1, wherein the oil separator comprises an oil drain in communication with a shell casing.

12. The compressor of claim 11, wherein the oil separator comprises a check valve on the oil drain.

13. A method of compressing a flow of carbon dioxide for use in a refrigeration system, comprising:

compressing the flow of carbon dioxide from a low pressure to an intermediate pressure in a first stage compressor;

passing the flow of carbon dioxide at the intermediate pressure through a J-tube with an inlet located at a bottom of an expansion chamber of an oil separator;

turning the flow of carbon dioxide approximately 180 degrees;

reducing a velocity of the flow of carbon dioxide in the oil separator; and compressing the flow of carbon dioxide from the intermediate pressure to a high pressure in a second stage compressor.

14. A compressor for use with a flow of a refrigerant, comprising:

a shell casing;

a first stage compression mechanism for compressing the flow of the refrigerant from a low pressure to an intermediate pressure positioned within the shell casing;

an oil separator downstream of the first stage compression mechanism and positioned outside the shell casing;

wherein the oil separator comprises a J-tube and an expansion chamber, the J-tube comprising an inlet at a bottom of the expansion chamber, an outlet within an expansion chamber and the wherein J-tube provides an approximate 180 degree turn to the flow of refrigerant;

a second stage compression mechanism downstream of the oil separator for compressing the flow of the refrigerant from the intermediate pressure to a high pressure positioned within the shell casing; and a motor to drive the first stage compression mechanism and the second stage compression mechanism positioned within the shell casing.

15. The compressor of claim 14, wherein the oil separator comprises an oil drain in communication with the shell casing.

16. The compressor of claim 14, wherein the refrigerant comprises a flow of carbon dioxide.

17. The compressor of claim 12, wherein the check valve comprises a biased check valve to ensure a sufficient volume of carbon dioxide within the oil separator.

18. The compressor of claim 15, wherein the oil drain comprises a biased check valve to ensure a sufficient volume of the refrigerant within the oil separator.

* * * * *